United States Patent [19]

Terasawa et al.

[11] 4,120,139

[45] Oct. 17, 1978

[54] CABLE MAKING APPARATUS

[75] Inventors: Shinichi Terasawa; Akitoshi Okamura; Shigeru Okuyama; Takehiko Nishiyama; Tadao Nishida, all of Higashi-Osaka, Japan

[73] Assignee: Tatsuta Densen Kabushiki Kaisha, Osaka, Japan

[21] Appl. No.: 819,035

[22] Filed: Jul. 25, 1977

[30] Foreign Application Priority Data

Jul. 29, 1976 [JP] Japan ..... 51-91736

[51] Int. Cl.[2] ..... D01H 13/02; D01H 13/04

[52] U.S. Cl. ..... 57/13; 57/106; 226/189

[58] Field of Search ..... 57/3, 11, 12, 13, 14, 57/77.42, 106; 226/189

[56] References Cited

U.S. PATENT DOCUMENTS

| | | | |
|---|---|---|---|
| 2,030,438 | 2/1936 | Franz | 57/13 |
| 2,255,108 | 9/1941 | Fischer | 57/11 |
| 2,342,343 | 2/1944 | Hotchkiss, Jr. | 57/11 |
| 3,370,642 | 2/1968 | Meier et al. | 226/189 X |
| 3,441,189 | 4/1969 | Erb et al. | 226/189 |
| 3,445,996 | 5/1969 | Berger, Jr. | 57/106 X |

*Primary Examiner*—Charles Gorenstein
*Attorney, Agent, or Firm*—Ladas, Parry, Von Gehr, Goldsmith & Deschamps

[57] ABSTRACT

Improvements in apparatus for the manufacture of a cable by laying or assemblying pre-twisted outer strands around a pre-twisted core. For smooth transmission of the pre-twist through the core length from a pay-out reel to a laying die, a series of interspaced pairs of opposed guide rollers are disposed along the path of the core to engage the same therebetween. Further, for smooth transmission of the pre-twists through the lengths of the outer strands from respective pay-out reels to the laying die, a series of interspaced tapered guide rollers are disposed along a curve in the path of each outer strand. At least some of the tapered guide rollers are set an an angle to the axial direction of the outer strand being fed thereover and, preferably, further to the direction normal to the vertical plane containing the curve in the outer strand path.

13 Claims, 18 Drawing Figures

CABLE MAKING APPARATUS

BACKGROUND OF THE INVENTION

This invention relates to cable-making apparatus, and more specifically to apparatus for assemblying a cable by laying outer strands around an axial core while imparting reversing or pre-twist thereto. Still more specifically, the invention is directed to some improvements in such cable-making apparatus which are intended to afford smooth transmission of pre-twists through the lengths of the outer strands and the core from respective pay-out means to a laying die.

Cables are in use which have an axial core of a multiplicity of layed wires and an outer layer comprising a plurality of strands each composed also of a number of wires. In conventional apparatus for the manufacture of such cables, the above cable components are fed from respective pay-out reels or drums to a laying die while being pre-twisted. On emerging from the die, the laid assembly of the outer strands around the core is taken up around a take-up reel or drum.

A problem in this known type of cable-making apparatus is that the pre-twists imparted to the individual cable components are not smoothly transmitted therethrough from the respective pay-out reels to the laying die. The pre-twists tend to accumulate at those portions of the cable components laying immediately next to the pay-out reels, until the resulting kinks are swept forwardly. Cables produced in this manner lack uniformity in pitch and diameter along their length.

For guiding the outer strands from their pay-out reels to the laying die, for example, the prior art apparatus employs large-diameter pulleys in engagement with respective strands. These pulleys are serious impediments to the transmission of the pre-twists through the outer strands. Rollers disposed along the path of the core from its pay-out reel to the laying die in the prior art apparatus are also unsatisfactory for assuring smooth transmission of the pre-twist through the core.

Japanese Patent Publication No. 36052/1974 discloses the use of concave rollers for guiding each strand or the assembled cable around a circuitous path while inducing the same to rotate about its own axis. These concave guide rollers, however, are intended for use in cable-making machines of the "caged" or revolving frame type to which the noted Japanese patent is directed, with the rollers mounted in a revolving frame. Such concave rollers have proved quite unsatisfactory when employed for guiding each outer strand along a stationary, curved path in cable-makig apparatus of the type to which the instant invention is directed.

When incorporated in cable-making apparatus of the revolving frame type, the concave rollers are admittedly capable of effectively guiding a strand or a cable while inducing its rotation about its axis, thanks to a centrifugal effect exerted thereon. When employed for guiding a pre-twisted strand along a stationary, curved path, however, the concave rollers do not permit smooth transmission of the pre-twist through the strand. This is primarily because the angle between the axis of each concave roller and its circumference increases too rapidly from the midpoint toward the outer ends thereof.

Another problem in the prior art is that such guide rollers are made of metal such as steel with or without chromium plating. Such metal-made guide rollers do not offer sufficient frictional resistance to the strand travelling thereover for efficient transmission of the pre-twist therethrough.

SUMMARY OF THE INVENTION

It is an object of this invention to provide cable-making apparatus having improved means for affording smooth transmission of pre-twists through the lengths of cable components from respective pay-out means to a laying die and hence to enable efficient manufacture of cables without objectionable variations in thickness or pitch.

After object of the invention is to provide such improved means which can be readily incorporated in known cable-making apparatus without major alteration of its existing parts.

With these and other objects in view, this invention provides, in cable-making apparatus of the type defined, means for guiding each outer strand from pay-out means to a laying die along a predetermined paths having a curve therein. The outer strand guiding means includes a series of interspaced tapered guide rollers which are disposed along the curve in the path so as to engage the outer strand being fed toward the die while being pretwisted, and at least some of which rollers are set at an angle to the direction transverse to the axis of the outer strand being fed thereover.

By these tapered guide rollers, which preferably are molded of polyurethane rubber or like material, the pre-twist imparted to each outer strand can be smoothly transmitted through its length from the pay-out means to the laying die. Clear distinction should be made between the tapered rollers of this invention and the concave rollers of the prior art. The diameter of each tapered roller in accordance with the invention decreases linearly from its opposite ends toward the midpoint or, alternatively, from one of its ends toward the other. Thus, each tapered roller can be either in the shape of two cone frustums joined together at their smaller-diameter ends or of a simple cone or its frustmun.

The invention is also directed to means for guiding a core from its pay-out means to the laying die so as to permit smooth transmission of the pre-twist therethrough. In a preferred embodiment of the invention, series of interspaced pairs of opposed guide rollers are disposed along the path of the core so as to engage the same therebetween.

Thus, in accordance with the invention, pre-twists imparted to the outer strands and the core can be smoothly transmitted through their lengths from the respective pay-out means to the laying die. It is therefore possible to assemble the outer strands around the core to form a closely twisted, defectless cable.

The above and other objects, features and advantages of this invention and the manner of attaining them will become more clearly apparent, and the invention itself will best be understood, upon consideration of the following detailed description and appended claims taken together with the accompanying drawings.

DETAILED DESCRIPTION

Figures 1, 2, 4:
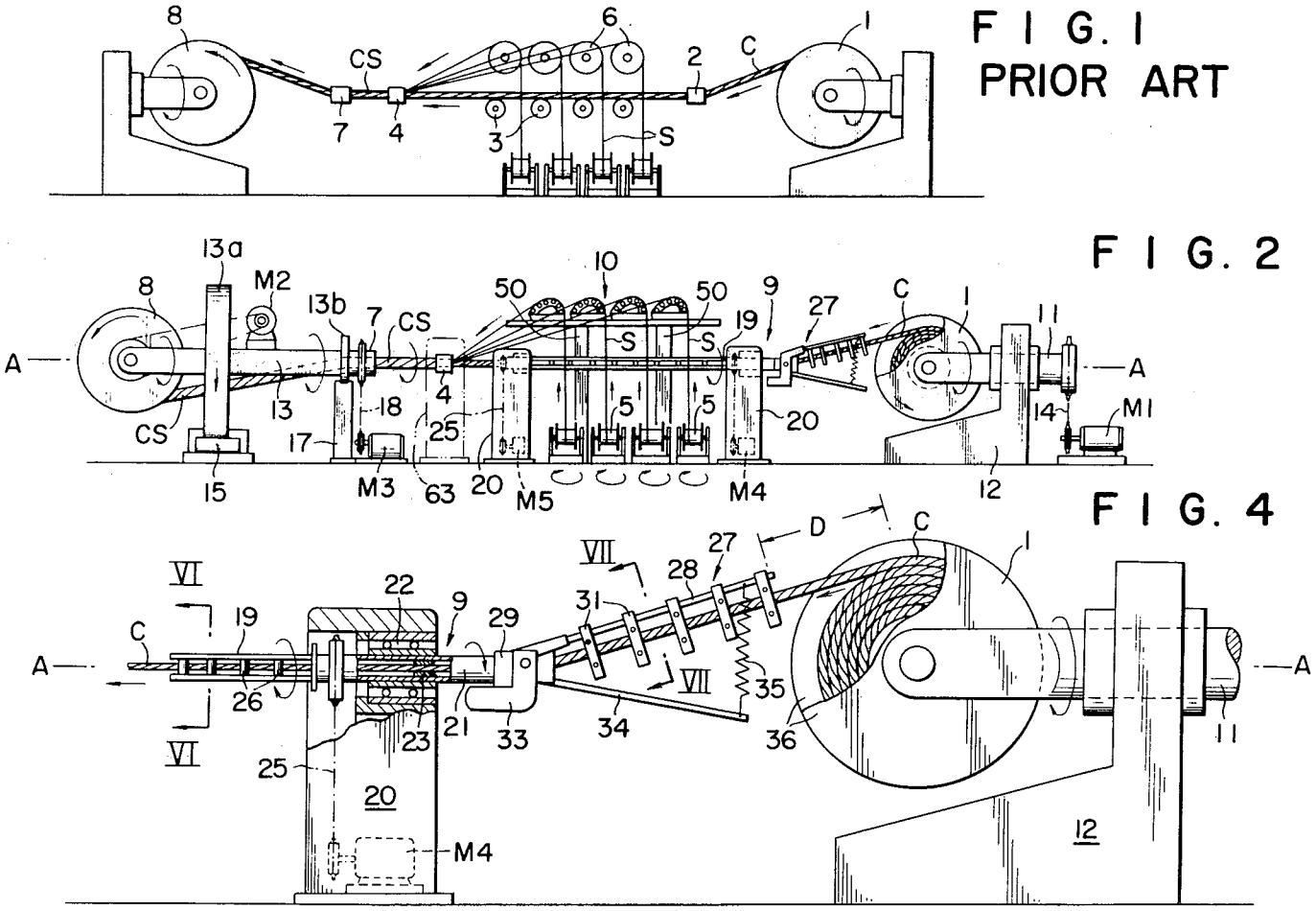
FIG. 1 PRIOR ART
FIG. 1 is a schematic side elevational view of conventional cable-making apparatus having particular pertinence to this invention.
FIG. 2 is a similar view of cable-making apparatus incorporating the improvements in accordance with the invention.
FIG. 4 is a fragmentary relatively enlarged side elevation, partly broken away and partly in section, of the cable-making apparatus of FIG. 2, the view showing in particular means for guiding a cable core from a payout reel toward a laying die while affording smooth transmission of a pre-twist therethrough.

The prior art cable-making apparatus of FIG. 1, to which the improvements of this invention can be applied to the best advantage, will first be described briefly in order to make clear the features and advantages of the invention. In this type of apparatus, a core C is delivered by a core pay-out reel or drum 1 and is passed horizontally through a guide die 2 and a series of guide rollers 3, into and through a stationary laying die 4. A plurality of outer strands S, to be laid around the core C at the laying die 4, are delivered substantially vertically upwardly by respective outer strand pay-out reels or drums 5, passed around respective large-diameter guide pulleys 6, and directed downwardly into and through the laying die 4 at angles to the die axis.

The core pay-out reel 1 is rotatable about a horizontal axis in alignment with the axis of the guide die 2 and also with that of the laying die 4, for imparting a reverse or pre-twist to the core C. Each outer strand payout reel 5 is also further rotatable about a vertical axis for imparting a pre-twist to one of the outer strands S. The laying die 4 is adapted to permit the core C and the outer strands S to slide axially therethrough but to resist the rotation of the same about their axes. After having passed through the laying die 4, the pre-twisted outer strands S are laid around the core C released from the pre-twist.

On issuing from the laying die 4, the laid or assembled cable CS is passed horizontally into and through another guide die 7 and is then wound up around a cable take-up reel or drum 8. This cable take-up reel is also further rotated about the horizontal axis in the same direction and at the same angular velocity as the core pay-out reel 1.

In the cable-making apparatus of the above outlined type, the smooth transmission and uniform distribution of pre-twists through the entire lengths of the core C and outer strands S from the respective pay-out reels 1 and 5 to the laying die 4 are of utmost importance for the manufacture of a cable having uniform quality and freedom from defects. As explained earlier, this objective cannot fully be attained by the rollers 3 or pulleys 6 (or by the concave rollers of the aforementioned Japanese Patent Publication No. 36052/1974) heretofore employed for guiding the core and outer strands from their pay-out reels to the laying die.

These shortcomings are totally absent from the improved cable-making apparatus of this invention illustrated in its entirety in FIG. 2. In the following description of this improved cable-making apparatus, some conventional parts are designated by the same reference numerals as those used to denote corresponding parts in the prior art apparatus of FIG. 1.

As in the illustrated prior art, the improved cable-making apparatus of FIG. 2 comprises the core pay-out reel 1 and the cable take-up reel 8 which are rotated in the same direction as indicated by the arrows and at the same angular velocity about a common, stationary first or horizontal axis A—A, and which are further rotatable about respective second or transverse axes revolving in vertical planes, the each of the outer strand pay-out reels 5 being rotatable about a stationary third or vertical axis and each further being rotatable about a fourth axis revolving in a horizontal plane, and the fixed laying die 4 disposed on or around the horizontal axis A—A between the reels 1 and 8 for laying the outer strands S around the core C into the cable CS.

Additionally, the improved cable-making apparatus of FIG. 2 comprises core guide means 9 for guiding the core C from the pay-out reel 1 toward the laying die 4 substantially along the horizontal axis A—A so as to permit smooth transmission of a pre-twist throught the core length from the pay-out reel to the laying die and outer strand guide means 10 employed in place of the conventional guide pulleys 6 for permitting smooth transmission of pre-twists through the lengths of the outer strands S from the respective pay-out reels 5 to the laying die 4. Each of the core C and outer strands S usually comprises a multiplicity, or plurality, of stranded wires.

Figure 3:
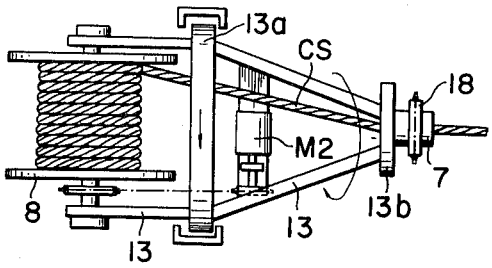
FIG. 3 is a plan view, on an enlarged scale, showing a cable take-up reel and its associated parts.

The core pay-out reel 1 is rotatably supported at a bifurcated end of a drive shaft 11 which is journalled in a bearing supported by a reel mount 12 for rotation about the horizontal axis A—A. The other end of the drive shaft 11, projecting rearwardly of the reel mount 12, is connected to the output shaft of an electric motor Ml via a chain drive 14. The cable take-up reel 8 is rotatably supported by a frame 13 which is carried by a rotary ring 13*a* resting on rollers 15 so as to be rotatable around the axis A—A, as also shown in FIG. 3. The reel 8 itself is driven in rotation by an electric motor M2 mounted on the frame 13 via a chain drive 16. The frame 13 has fixedly connected thereto another rotary ring 13*b* rotatably resting on a pedestal 17. The frame 13 further has a guide die 7 which is driven in rotation with the frame 13 by means of an electric motor M3 via a chain drive 18. The core pay-out reel 1 and the cable take-up reel 8 can therefore be rotated about the common axis A—A by the respective motors M1 and M3.

It will be noted that the motor M2 rotates the cable take-up reel 8 in the counterclockwise direction as viewed in FIG. 2, or cable take-up direction, about the revolving transverse axis. Preferably, still another electric motor, not shown, is provided for rotating the core pay-out reel 1 in the counterclockwise or core pay-out direction about the revolving transverse axis.

The core guide means 9 includes an elongated, revolving guide frame 19 extending along the horizontal axis A—A and located between the core pay-out reel 1 and the laying die 4 to provide therein a passage through which the core C is fed forwardly from the reel toward the die. The guide frame 19 is supported at the two ends by a pair of upstanding standards 20 for rotation about the axis A—A.

Figure 5:
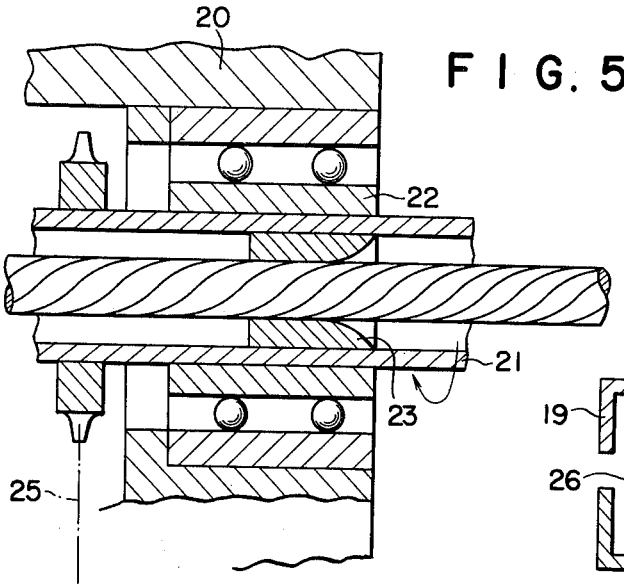
FIG. 5 is a fragmentary vertical sectional view showing, on a still further enlarged scale, a guide die and associated means seen in FIG. 4.

As illustrated on an enlarged scale in FIG. 4 and on a still further enlarged scale in FIG. 5, the guide frame 19 terminates at both ends in hollow shafts 21. The rear or right hand one of these hollow shafts is journalled in a bearing 22 supported by one of the standards 20 and has a guide die 23 fixedly mounted therein for somewhat loosely receiving and passing the core C through the die. An electric motor M4 is disposed within the right hand standard 20 and has its output shaft coupled to the hollow shaft 21 via a chain drive 25 for imparting rotation, in the direction indicated by the arrows, to the guide frame 19 about the horizontal axis A—A.

Although not seen in FIGS. 4 and 5, the hollow shaft at the front or left hand end of the guide frame 19 is similarly supported in a bearing on the associated standard 20. Additionally, another electric motor M5 is disposed within the left hand a standard 20 for imparting rotation to the guide frame 19 via a chain drive 25. The two motors M4 and M5 are adapted to drive the guide frame 19 in the same direction and at the same angular velocity as the core pay-out reel 1 and the cable take-up reel 8 about the common horizontal axis A—A.

Figure 6:
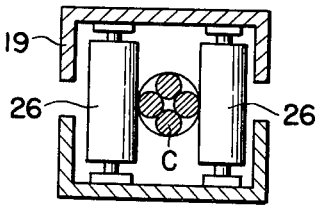
FIG. 6 is an enlarged sectional view taken along the line VI—VI in FIG. 4.

FIGS. 4 and 6 illustrate a series of constantly spaced-apart pairs of opposed core guide rollers 26 disposed within the revolving guide frame 19 in order to afford smooth transmission of a pre-twist through the core length extending within the guide frame. The core guide rollers 26 are shown as plain cylinders, and as clearly seen in FIG. 6, each pair of guide rollers are rotatable relative to the guide frame 19 about parallel spaced axes, respectively, revolving in a vertical plane transverse to the axis A—A. The pre-twisted core C is caught under some pressure between each pair of guide rollers 26.

FIG. 4 is further illustrative of another feature of this invention which resides in means 27 for smooth transmission of the pre-twist through the core length extending from the pay-out reel 1 to the entrance end of the revolving guide frame 19 or of its right hand end hollow shaft 21. The means 27 includes an elongated support member 28 pivotally coupled to the entrance end of the right hand hollow shaft 21 via a universal joint 29 and extending therefrom toward the core pay-out reel 1 along the core C.

Figure 7:
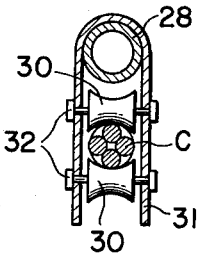
FIG. 7 is an enlarged sectional view taken along the line VII—VII in FIG. 4.

As will be seen from the enlarged sectional view given in FIG. 7, the support member 28 supports a series of constantly interspaced pairs of opposed core guide rollers 30 via clevises 31. The support member 28 is shown to be in the form of a tube, and the U-shaped clevises 31 are suitably secured to the support member at their bight portions so as to embrace the core C extending therealong. Preferably concave in shape, each pair of core guide rollers 30 are supported by one of the clevises 31 via parallel spaced crosspins 32 for rotation relative to the clevis about the crosspin axes transverse to the axis of the core length between the core pay-out reel 1 and the entrance end of the right hand hollow shaft 21. The pre-twisted core C is caught under pressure between each pair of concave guide rollers 30.

On close observation of the core C being unwound from the pay-out reel 1 while being pre-twisted by the reel rotation about the horizontal axis A—A, it is clear that the pre-twist tends to accumulate at the core region lying immediately next to the reel. In view of this, therefore, the rearmost one of the concave core guide roller pairs 30 may be disposed as close as possible to the core pay-out reel 1. For practical purposes, however, the distance D between the rearmost pair of guide rollers 30 and the point at which the core C is paid out from the pay-out reel 1 should be less than twice the pitch of the pre-twist imparted to the core.

A counterweight 33 extends forwardly from the universal joint 29 to counterbalance the total weight of the support member 28, core guide rollers 30 and other means mounted on the joint. Further, a dummy 34 of the support member 28 extends rearwardly from the universal joint 29 at an angle to the horizontal axis A—A and in opposed relation to the support member. The far end of the dummy 34 is coupled to the corresponding end of the support member 28 via a coil spring 15 in order to minimize the centrifugal effect on the core guide rollers 30 during operation of the cable-making apparatus.

Preferably, the universal joint 29 should be provided with means for limiting the latitude of the pivotal motion of the support member 28 with respect to the hollow shaft 21 in such a way that the support member is pivotable through an angle corresponding to the spacing between the pair of flanges 36 of the core pay-out reel 1 and through an angle corresponding to the difference between the maximum and minimum diameters of the coil of core C on the reel. It is also preferable that the support member 28 be made of several unitary sections which can be readily interconnected with or disconnected from each other in order to adjustably vary the total length of the support member as required.

Thus, as the core pay-out reel 1 is rotated as aforesaid about the horizontal axis A—A by the motor M1 and further about its transverse axis, the pre-twist imparted to the core C being delivered from the pay-out reel can be smoothly transmitted to the entrance end of the right hand hollow shaft 21 by the series of concave guide roller pairs 30. Since the guide frame 19 together with the pair of hollow shaft 21 at its opposite ends in rotated as aforesaid about the horizontal axis A—A by the motors M4 and M5 in step with the pay-out reel 1, and since the pairs of concave guide rollers 30 are coupled to the right hand hollow shaft 21 via the support member 28 and the universal joint 29, the guide roller pairs can be maintained in positive engagement with the core C in synchronization with the rotation of the pay-out reel about the axis A—A and from the start to the end of the unreeling of the core coil on the reel.

The pre-twist is further smoothly transmitted from the guide die 23 through the core length within the revolving guide frame 19 by the series of guide roller pairs 26 mounted therein. It is thus seen that the pre-twist imparted to the core C can be smoothly transmitted and uniformly distributed through the complete length of the core extending from the core pay-out reel 1 to the laying die 4.

Figure 8:
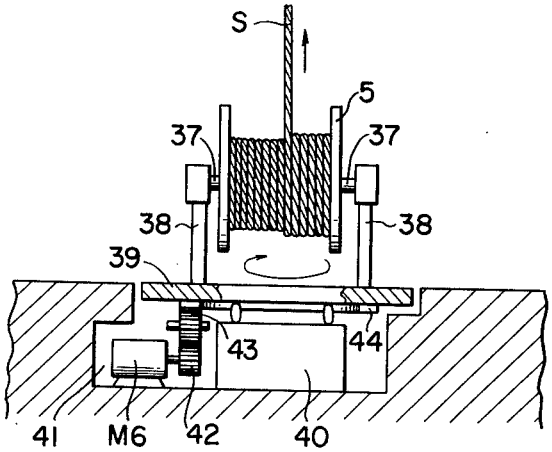
FIG. 8 is an enlarged elevational view, partly in section, of one of outer strand pay-out reels and means for revolving the same about a vertical axis in the cable-making apparatus of FIG. 2.

FIG. 8 illustrates in detail one of the outer strand pay-out reels 5 and associated means. It is understood that the other reels are constructed and arranged identically. Carrying a coil of outer strand S, the illustrated pay-out reel 5 is mounted on a shaft 37 rotatable in bearings mounted on uprights 38, respectively, that are erected on a turntable 39. This turntable is disposed at the floor level and is rotatably supported by suitable means 40 mounted in an underground chamber 41. Also mounted in the chamber 41, an electric motor M6 has a pinion 42 fixedly mounted on its output shaft and meshing through a gear 43 with an annular rack 44 fixed to the underside of the turntable 39.

Upon rotation of the motor M6, therefore, the outer strand pay-out reel 5 is rotated about the afore-mentioned third or vertical axis together with the turntable 39 via the rack-and-pinion mechanism. The pay-out reel itself is further rotatable about the fourth axis revolving in a horizontal plane. If desired or required, a separate motor may be provided for driving the pay-out reel 5 in the strand unreeling direction.

Figure 9:
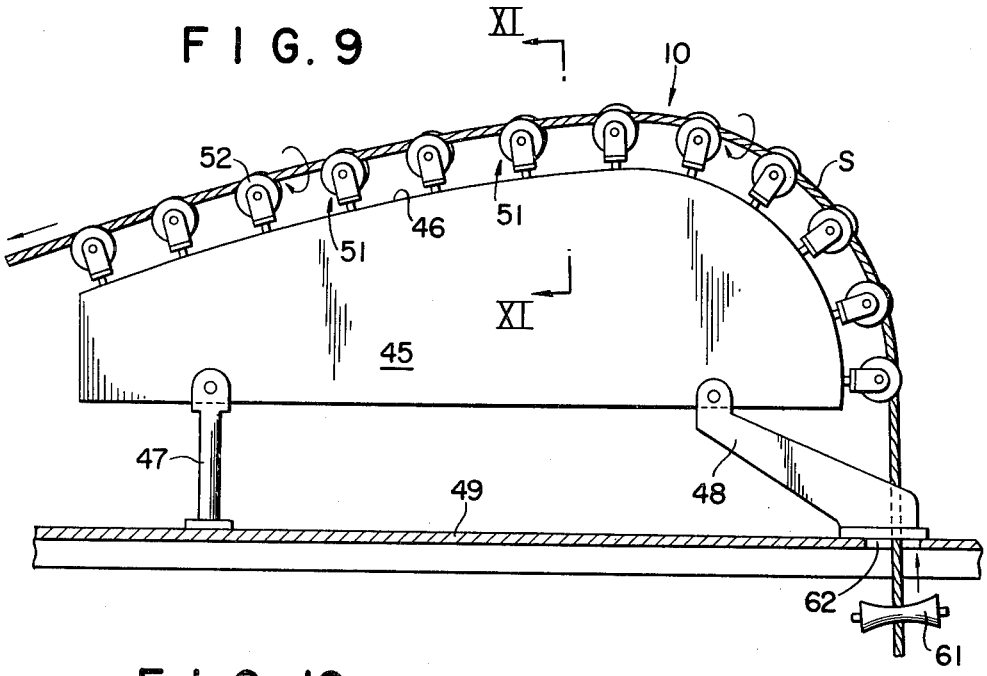
FIG. 9 is an enlarged elevational view of the means for guiding each outer strand along a curve present in its path from the pay-out reel to the laying die so as to afford smooth transmission of a pre-twist therethrough, in the cable-making apparatus of FIG. 2.
Figure 10:
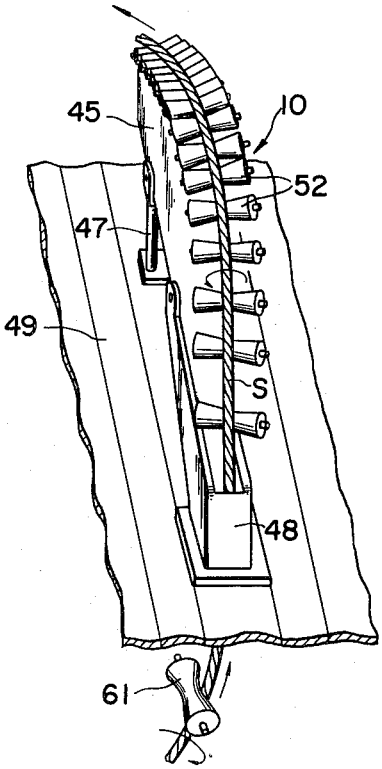
FIG. 10 is a perspective view of the outer strand guiding means of FIG. 9, the view not showing the supporting and mounting means of tapered guide rollers included in the guiding means.

FIGS. 9 and 10 are enlarged representations of the outer strand guide means 10 intended to afford smooth transmission of pre-twists, which are imparted to the outer strands S by the rotation of the respective pay-out reels 5 about the vertical axes, through the full outer strand lengths from the pay-out reels to the laying die 4. The guide means 10 includes a guide frame 45 having a curved edge 46 extending along a curve which must be present in the path of travel of each outer strand S from one of the pay-out reels 5 to the laying die 4. The guide frame 45 is fixedly mounted by brackets 47 and 48 on an elevated platform 49 supported by two or more columns 50 shown in FIG. 2. The radius of curvature at any point on the guide frame edge 46 should not be so small as to hamper the desired smooth transmission of the pre-twist through the outer strand S.

Figure 11:
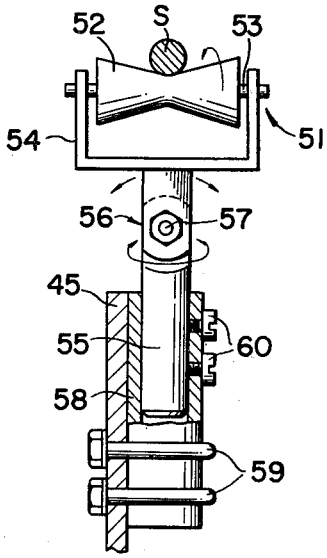
FIG. 11 is a still further enlarged sectional view, partly broken away, which is taken along the line XI—XI in FIG. 9, and which shows one of the tapered guide rollers together with its supporting and mounting means.

Mounted on and extending along the curved edge 46 of the guide frame 45 are a series of interspaced outer strand guide roller assemblies 51 including tapered rollers 52. As illustrated in greater detail in FIG. 11, the tapered roller 52 of each guide roller assembly 51 is free to turn about a crosspin 53 supported by a clevis 54. This clevic is mounted on a shaft or rod 55 via a knuckle joint 56 including a lock bolt 57, and the shaft 55 is slidably fitted in a sleeve 58 which is fastened to the guide frame 45 as by means of eyebolts 59. One or more setscrews 60 extend through tapped holes in the sleeve 58 for locking the shaft 55 against movement in a desired angular position with respect to the sleeve.

The outer parts of the tapered rollers 52 are made of an elastomer such as polyurethane or polyester rubber, or of any such material capable of offering higher frictional resistance than metal to the outer strand S being fed thereover. In shape, each tapered roller 52 decreases linearly in diameter from its opposite ends toward the midpoint and is thus shaped like two cone drustums joined together at their reduced diameter ends and in axial alignment. The ratio of the minimum to the maximum diameter of each tapered roller 52 is from about 1/5 to about 2/3, preferably about 2/5. It has been ascertained by experiment that tapered rollers whose diameter ratios are outside of this range tend to cause distortion, disarrangement, or lateral displacement of the pre-twisted outer strand S travelling thereover.

The guide roller assemblies 51 constructed as described above are set up on and along the curved edge 46 of the guide frame 45, with their tapered rollers 52 in engagement with one of the outer strands S extending substantially vertically upwardly from the corresponding pay-out reel 5 via a guide roller 61 and an opening 62 in the platform 49. In this particular example, the spacings between the tapered rollers are less than about 200 millimeters, preferably about 100 millimeters.

Figure 12:
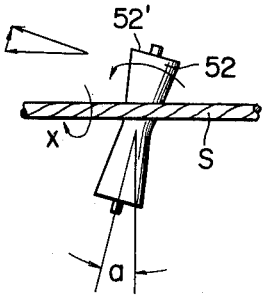
FIG. 12 is a plan view explanatory of the angular position of each tapered guide roller with respect to the axial direction of the outer strand being fed thereover.
Figure 13:
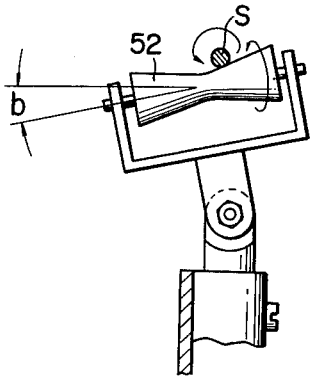
FIG. 13 is a view similar to FIG. 11 but explanatory of the angular position of each tapered guide roller with respect to the direction normal to the vertical plane containing the curve in the path of the outer strand.
Figure 14:
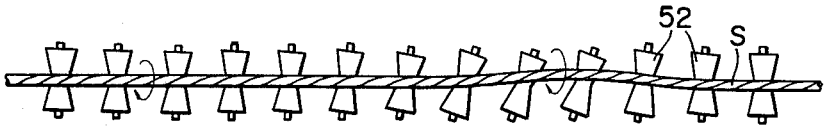
FIG. 14 is a schematic plan view explanatory of the angular orientations of all tapered guide rollers with respect to the axial direction of the outer strand being fed thereover.
Figure 15:
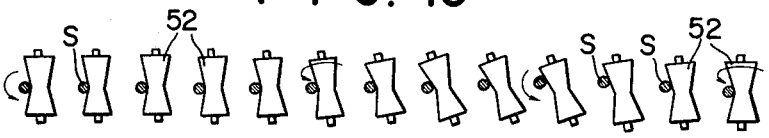
FIG. 15 is a series of views explanatory of the angular orientations of all tapered guide rollers with respect to the direction normal to the vertical plane containing the curve in the outer strand path.

As best shown in FIG. 12, at least some of the tapered rollers 52 are set at an angle *a* relative to the direction transverse to the axial direction of the outer strand S travelling thereover. Preferably, as shown in FIG. 13, at least some of the tapered rollers 52 should further be set at an angle *b* relative to the direction normal to the vertical plane containing the curved edge 46 of the guide frame 45. FIGS. 14 and 15 are explanatory of such angular orientations of all tapered rollers 52 on the guide frame 45.

With the tapered rollers 52 of the guide roller assembies 51 arranged as described above on the curved edge 46 of the guide frame 45, the outer strand S in its axial motion imparts rotation to each tapered roller, resulting in the creation of a frictional fore component which acts on the outer strand to displace the same toward the larger diameter end 52' shown in FIG. 12. As a consequence, the outer strand S is caused to turn about its axis as indicated by the arrow *x* in FIG. 12. It will be understood that such a force component induces the rotation of the strand about its axis and hence enables smooth transmission of a pre-twist through the strand from one tapered roller to the next toward the laying die 4. It is to be noted that the inclined arrangement of the rollers 52 at the angle *b* is also useful in inducing the rotation of the strand in the direction of the arrow *x*. As the strand climbs up the tapered surface of the roller 52, the tension of the strand increase and hence the strand tends to move down the tapered surface to relieve itself of the high tension, which tendency causes the strand to turn in the direction of the arrow *x*.

It will be seen that the tapered rollers 52 need not be all set at the same angles *a* and *b*. Indeed, in the illustrated embodiment, these angles must be greater at the mid-portion of the guide frame edge 46 where the radius of curvature is the smallest, than at the entrance and exit end portions of the guide frame edge which are curved ever so slightly or hardly curved at all. Generally speaking, the angle *a* between the axis of each tapered roller 52 and the direction transverse to the axial direction of the outer strand S being fed thereover can range from 0° to about 13°, and the angle *b* between the tapered roller axis and the direction normal to the vertical plane containing the guide frame edge 46 can range from 0 to about 23 degrees. Such angular dispositions of the tapered rollers 52 can be easily adjusted as required by manipulation of the lock bolts 57 and the setscrews 60 of the outer strand guide roller assemblies 51.

Preferably, the total length of those portions of each outer strand S which are in contact with the series of tapered rollers 52 at every moment should be more than twice the pitch of the pre-twist of the strand. Further, the angle of the front slope of each guide frame edge 46 should be approximately the same as the angle at which the corresponding outer strand S is fed into the laying die 4.

Figure 16:
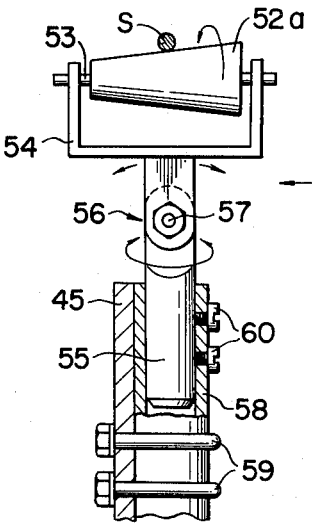
FIG. 16 is a view of a modified tapered guide roller which can be used in the outer strand guiding means of FIGS. 9 and 10.

As will be seen from the foregoing description of the functions of the tapered rollers 52, only the upper halves, as seen in FIGS. 12, 14 and 15, or these rollers serve for smooth transmission of the pre-twist through the outer strand S. Each tapered roller can therefore be provided in the shape of a simple cone or its frustum, as illustrated in FIG. 16 and designated at 52*a*. It has been ascertained that a strand travelling over such conical or frustoconical rollers will not easily slip off the reduced diameter end of each roller, either when the cable-making apparatus is in operation or when it is at rest.

Figure 17:
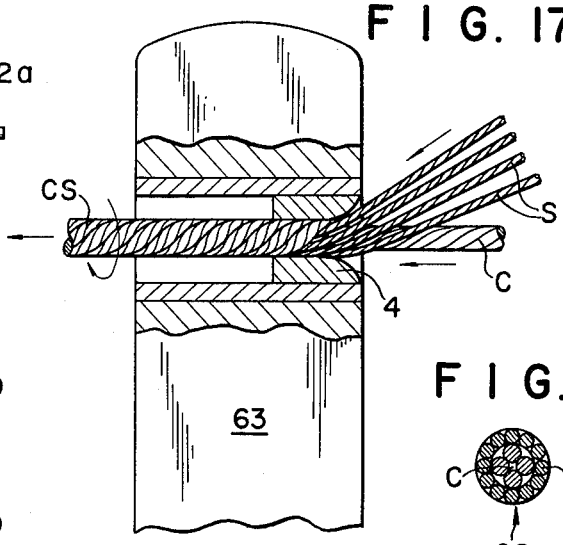
FIG. 17 is an enlarged, vertical sectional view of the laying die in the cable-making apparatus of FIG. 2, the view also showing the core and the outer strands being fed through the die and assembled into a cable.

FIG. 17 illustrates in detail the laying die 4 fixedly mounted in an upstanding standard 63, together with the core C and the outer strands S being fed into the die in the process of assemblage into the desired cable CS. On issuing from the laying die 4, the assembled core C and outer strands S are freed from the pre-twists which have been applied thereto and are formed into the closely laid or twisted cable.

Since the pre-twists can be smoothly and uniformly transmitted through the entire lengths of the cable components from the respective pay-out reels 1 and 5 to the laying die by the improved means of this invention, a cable CS of improved characteristics including greater uniformity in diameter and pitch can be manufactured. The method of assemblage of the pre-twisted core and outer strands into the cable is per se conventional and will therefore be not described in any greater detail.

Figure 18:
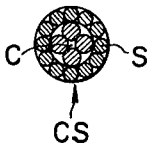
FIG. 18 is a cross section of the cable.

With reference back to FIG. 2, the assembled cable CS is fed from the laying die 4 to the conventional guide die 7 which is in constant rotation about the horizontal axis A—A with a frame 13 connecting the guide die 7 to the cable take-up reel 8. Issuing from the guide die 7, the cable CS is taken up by and coiled around the cable take-up reel 8, which is in rotation not only about the transverse axis but also about the axis A—A. The cross-section of the cable CS thus assembled is as shown in FIG. 18.

Although the improved cable-making apparatus of this invention has been shown and described in terms of its preferable form, it is understood that the invention itself is not to be restricted by the exact details of this disclosure. Various modifications or changes in the construction of individual parts or components and in the overall configuration of the apparatus may be resorted to by those skilled in the art without departing from the spirit or scope of the invention.

We claim:

1. In apparatus for assemblying a cable by laying outer strands around a core, wherein the apparatus is of the type including core pay-out means and cable take-up means rotatable in the same direction about a common, stationary first axis and further rotatable about revolving second axes transverse to the first axis for paying out the core and taking up the assembled cable, respectively, a plurality of outer strand pay-out means each rotatable about a stationary third axis and each further rotatable about a revolving fourth axis transverse to the third axis for paying out one of the outer strands, and a stationary laying die disposed on the first axis between the core pay-out means and the cable take-up means for closely receiving and passing therethrough the outer strands and the core so as to assemble for the former around the latter, the improvement which comprises means for guiding the core from the core pay-out means to the laying die substantially along the first axis, the core guiding means including means for smoothly transmitting a pre-twist, which is imparted to the core by the rotation of the core pay-out means about the first axis, through the length of the core from the core pay-out means to the laying die, and means for guiding each outer strand from one of the outer strand pay-out means to the laying die along a path having a curve therein, the outer strand guiding means including a series of interspaced linearly tapered rollers disposed along the curve in the path of each outer strand and held in engagement therewith, at least some of the tapered rollers being each set at an angle to the direction transverse to the axial direction of the outer strand being fed thereover, whereby a pretwist imparted to each outer strand by the rotation of one of the outer strand pay-out means about the third axis is smoothly transmitted through the length of the outer strand from the outer strand pay-out means to the laying die, and whereby the core and the outer strands can be assembled into the cable of improved characteristics.

2. The apparatus as recited in claim 1, wherein the ratio of the minimum to the maximum diameter of each tapered roller is in the range of from about 1/5 to about 2/3.

3. The apparatus as recited in claim 1, wherein each series of tapered rollers are set at an angle ranging from 0° to about 13° with respect to the direction transverse to the axial direction of the outer strand being fed thereover.

4. The apparatus as recited in claim 1, wherein at least some of the tapered rollers of each series are further set at an angle to the direction normal to a plane containing the curve in the path of the outer strand being fed thereover.

5. The apparatus as recited in claim 4, wherein each series of tapered rollers are set at an angle ranging from 0° to about 23° with respect to the direction normal to the plane containing the curve in the path of the outer strand.

6. The apparatus as recited in claim 4, further comprising means for supporting each tapered roller so as to permit easy adjustment of the angular positions of the tapered roller with respect to the direction transverse to the axial direction of the outer strand being fed thereover and to the direction normal to the plane containing the curve in the path of the outer strand.

7. The apparatus as recited in claim 1, wherein each tapered roller decreases in diameter from its opposite ends toward its midpoint.

8. The apparatus as recited in claim 1, wherein each tapered roller decreases in diameter from one of its ends toward the other end.

9. The apparatus as recited in claim 1, wherein the tapered rollers are made of material capable of offering more frictional resistance than metal to the outer strands being fed thereover.

10. The apparatus as recited in claim 1, wherein the core guiding means includes revolving guide frame means extending along and being rotatable about the first axis for receiving and passing therethrough the core delivered from the core pay-out means toward the laying die, and wherein the pre-twist transmitting means comprises a universal joint, a support member connected to an entrance end of the revolving guide frame means via the universal joint so as to extend along the core length from the core pay-out means to the entrance end of the revolving guide frame means, and a series of interspaced pairs of opposed guide rollers rotatably mounted on the support member so as to engage the core therebetween.

11. The apparatus as recited in claim 10, wherein the guide rollers of the pre-twist transmitting means are concave in shape.

12. The apparatus as recited in claim 10, wherein the pre-twist transmitting means further comprises means for reducing the centrifugal effects on the support member and the guide rollers.

13. The apparatus as recited in claim 10, wherein the pre-twist transmitting means further comprises a series of interspaced pairs of opposed second guide rollers rotatably mounted within the revolving guide frame means so as to engage the core therebetween.

* * * * *